US005188082A

United States Patent [19]

Udo et al.

[11] Patent Number: 5,188,082

[45] Date of Patent: Feb. 23, 1993

[54] FUEL INJECTION CONTROL SYSTEM FOR INTERNAL COMBUSTION ENGINE

[75] Inventors: Hiroshi Udo; Hatsuo Nagaishi; Tadaoki Takasaki; Kou Ido, all of Kanagawa, Japan

[73] Assignee: Nissan Motor Co., Ltd., Yokohama, Japan

[21] Appl. No.: 846,665

[22] Filed: Mar. 5, 1992

[30] Foreign Application Priority Data

Mar. 8, 1991 [JP] Japan ..... 3-043433

[51] Int. Cl.[5] ..... F02M 51/00

[52] U.S. Cl. ..... 123/491; 364/431.1

[58] Field of Search ..... 123/491, 492, 179.16, 123/179.14, 174.3; 364/431.1

[56] References Cited

U.S. PATENT DOCUMENTS

| | | | |
|---|---|---|---|
| 4,543,937 | 10/1985 | Amano et al. | 123/491 |
| 4,628,883 | 12/1986 | Kataoka | 123/489 |
| 4,765,300 | 8/1988 | Fujimura et al. | 123/491 |
| 4,844,039 | 7/1989 | Osaki et al. | 123/491 |
| 4,875,443 | 10/1989 | Sano et al. | 123/179.16 |
| 4,892,076 | 1/1990 | Toshimits et al. | 123/491 |
| 5,092,297 | 3/1992 | Tsukamoto et al. | 123/491 |
| 5,099,813 | 3/1992 | Kurosu et al. | 123/491 |
| 5,107,431 | 4/1992 | Ohta et al. | 364/431.1 |

FOREIGN PATENT DOCUMENTS 1-290939 11/1989 Japan .

*Primary Examiner*—Raymond A. Nelli

*Attorney, Agent, or Firm*—Foley & Lardner

[57] ABSTRACT

An electronically controlled fuel injection control system for an automotive internal combustion engine equipped with a hot wire mass air flow sensor to detect an intake air flow amount. The fuel injection control system is comprised of a microcomputer adapted to control the amount of fuel to be injected from a fuel injector mainly in accordance with an engine speed and the intake air flow amount. In the control by the microcomputer, an compensation for time lag is applied onto an intermediate variable which is calculated from the intake air flow amount and used for calculating the fuel injection amount. During an engine starting time period from an engine starting to the time immediately after the engine starting, the compensation for time lag is prohibited until the engine speed has reached a predetermined level, thereby preventing engine control from becoming different between a case when the engine starting is made immediately after the instant of an electric power supply and another case when the engine starting is made upon waiting a little while after the engine starting.

10 Claims, 7 Drawing Sheets

FUEL INJECTION CONTROL SYSTEM FOR INTERNAL COMBUSTION ENGINE

BACKGROUND OF THE INVENTION

1. Field of the Invention

This invention relates to improvements in a fuel injection control system for an internal combustion engine, and more particularly to improvements in the fuel injection control system in which a fuel injection amount control is made depending upon an intake air flow amount detected by a hot wire mass air flow sensor.

2. Description of the Prior Art

Hitherto, a fuel injection control for an automotive internal combustion engine has been usually accomplished as follows: First, an intake air flow amount Q is detected in accordance with a signal from an air flow sensor or meter disposed in an intake air passageway of the engine. Then, a basic fuel injection amount $Tp=K\times Q/N$ (K=constant, N=engine speed) is calculated in accordance with the intake air flow amount Q. A variety of corrections are applied to the basic fuel injection amount Tp to obtain a final fuel injection amount Ti according to which the fuel injection control is made. In addition to such a fuel injection control, it has been proposed to prevent air-fuel mixture to be supplied to engine cylinders from becoming too rich or too lean during acceleration or deceleration by applying a compensation for time LAG (such as obtaining a moving average) on the intake air flow amount Q or the basic fuel injection amount Tp. This is disclosed in Japanese Patent Provisional Publication No. 1-290939.

In the case of using a hot wire mass air flow sensor to detect the above-mentioned intake air flow amount Q, the instant an electric power supply is made to a variety of electrical equipments in the automotive vehicle, a large amount of electric current unavoidably flows through the air flow sensor so that the air flow sensor outputs a high level (voltage) signal. It has been confirmed that there is a tendency that the intake air flow amount Q unavoidably takes a higher value than a value corresponding to an actual air flow amount when the detection of the air flow amount Q is made during such an instant.

Accordingly, if the compensation for time lug is applied to the intake air flow amount Q or the basic fuel injection amount Tp during engine starting the influence of the flow of a large amount of air unavoidably remains to a considerable extent after the engine starting where the engine starting is made immediately after the instant electric power is supplied to a variety of equipment. Additionally, owing to such an inaccurate detection of the intake air flow amount Q, there comes out a large difference in the detected air-fuel ratio of air-fuel mixture to be inducted into the engine, between a case when the engine starting is made immediately after the instant of power supply and another case when the engine starting is made a little while after the instant of power supply. This causes emsission of CO and HC (hydrocarbons) and engine speed rising behaviors to largely scatter, thereby making engine control unstable during engine starting.

SUMMARY OF THE INVENTION

It is an object of the present invention to provide an improved fuel injection control system for an internal combustion engine, by which engine control during engine starting is made stable, thereby preventing emission of CO and HC and engine speed rising behavior during engine starting from largely scattering.

Another object of the present invention to provide an improved fuel injection control system for an internal combustion engine, by which the baneful influence of compensation for time lug during engine starting can be effectively avoided even when a hot wire mass air flow sensor is used to detect an intake air flow amount.

A fuel injection control system of the present invention is for an internal combustion engine having an air flow sensor and a fuel injector valve. The fuel injector control system is comprised of first means for detecting an intake air flow amount in accordance with a signal generated by the air flow sensor. Second means is provided to calculate a fuel injection amount in accordance with the intake air flow amount. Third means is provided to control a fuel injection from the fuel injector valve in accordance with the fuel injection amount. Fourth means is provided to apply a compensation for time lug in a process of calculation for obtaining the fuel injection amount. Fifth means is provided to detect a rising engine speed during a time period from an engine starting to a time (for example, 1 to 2 seconds) immediately after the engine starting. Additionally, sixth means is provided to reduce an effect of the compensation for time LAG until the engine speed has reached a predetermined value.

Thus, according to the present invention, the effect of the compensation for time LAG is reduced until the rising engine speed has reached the predetermined value during the time period from the engine starting to the time immediately after the engine starting. Accordingly, the baneful influence due to the hot wire mass air flow sensor outputting the high level signal can be effectively avoided thereby omitting a difference in engine control between different cases when engine startings are made respectively immediately after the power supply and upon waiting a little while after the power supply.

DETAILED DESCRIPTION OF THE INVENTION

Figure 1:
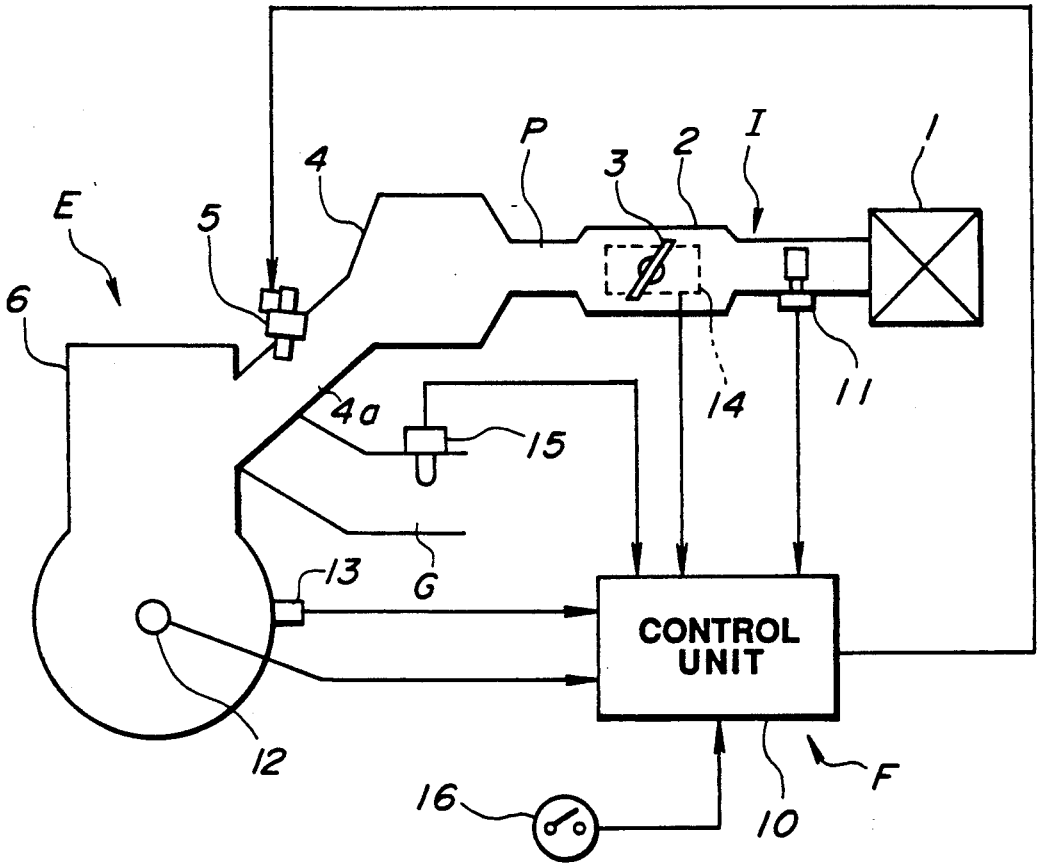
FIG. 1 is a schematic illustration of an internal combustion engine provided with an embodiment of a fuel injection control system according to the present invention.

Referring now to FIG. 1, an embodiment of a fuel injection control system F according to the present invention is shown incorporated with an internal combustion engine E. In this embodiment, the engine E is of an automotive vehicle and comprises an intake system I which includes an intake air passageway P through which air flows and is sucked into the engine cylinders (not shown) of an engine body 6. The intake air passageway P is communicable at its one end with the engine cylinders of the engine body 8. The intake system I includes an air filter 1 which is connected with the intake air passageway P at another end. A throttle chamber 2 is formed in the intake air passageway P downstream of the air filter 1. A throttle valve 3 is rotatably disposed in the throttle chamber 2 and operatively connected to and in relation to an accelerator pedal (not shown). The intake system I includes an intake mainfold 4 which has a plurality of branch runners 4a which are respectively connected with the engine cylinders, so that the inside of the intake manifold forms part of the intake air passageway P.

A fuel injector valve 5 is disposed in each branch runner 4a of the intake manifold 4 to inject fuel into the branch runner 4a at a location immediately upstream of the corresponding engine cylinder, so that the injected fuel is mixed with intake air flowing through the intake air passageway P and inducted into the engine cylinder. The fuel injector valve 5 is supplied with fuel which is fed from a fuel pump (not shown) and regulated in pressure by a pressure regulator (not shown). The fuel injector valve 5 includes a valve section (not shown) which is adapted to open upon energizing an electromagnetic coil (not shown) disposed in the valve 5 and to close upon deenergizing the same coil. The fuel supplied to the fuel injector valve 5 is injected through the valve section when the valve section is opened. The energizing of the electromagnetic coil is made by an operating pulse signal from a control unit 10 forming part of the fuel injection control system F.

The control unit 10 is supplied with signals from a variety of sensors one of which is a hot wire mass air flow sensor 11 which is electrically connected to the control unit 10 and disposed in the intake air passageway P between the throttle chamber 2 and the air filter 1. The air flow sensor 11 is adapted to output a voltage signal representative of an intake air flow amount Q or the flow amount of air passing through the intake air passageway P. The air flow sensor 11 is electrically connected to the control unit 10. A crank angle sensor 12 is provided to output signals representative of crank angles of a crankshaft (not identified) of the engine body 6. The signals include a unit signal output at intervals of a crank angle of 1 to 2 degrees, and a standard signal output at intervals of a crank angle of 270 degrees/n(=number of engine cylinders). The crank angle sensor 13 is electrically connected to the control unit 10. It will be understood that an engine speed N can be calculated according to the cycle or the like of the standard signal.

An engine coolant temperature sensor 13 is provided to detect an engine coolant temperature Tw or the temperature of an engine coolant (not shown). The engine coolant temperature sensor 13 is electrically connected to the control unit 10 and adapted to output a signal representative of the engine coolant temperature Tw. A throttle sensor 14 is provided to detect a throttle valve position or opening degree TVO of the throttle valve 3 and adapted to output a signal representative of the throttle valve opening degree TVO. An oxygen sensor 15 is disposed in an exhaust gas passageway G through which exhaust gas from the engine body 6 flows and is discharged out of the engine E. The exhaust gas passageway G is communicable with the engine cylinders of the engine body 6. The oxygen sensor 15 is provided to detect an oxygen concentration in the exhaust gas flowing through the exhaust gas passageway G and adapted to output a signal representative of the oxygen concentration. The information of oxygen concentration represents that the air-fuel ratio of air-fuel mixture to be supplied to the engine cylinders is low (rich) or high (lean). The oxygen sensor 15 is electrically connected to the control unit 10. Additionally, an engine starter switch 16 is electrically connected to the control unit 10 so that a signal representing the starting of the engine is output to the control unit 10.

Figure 2:
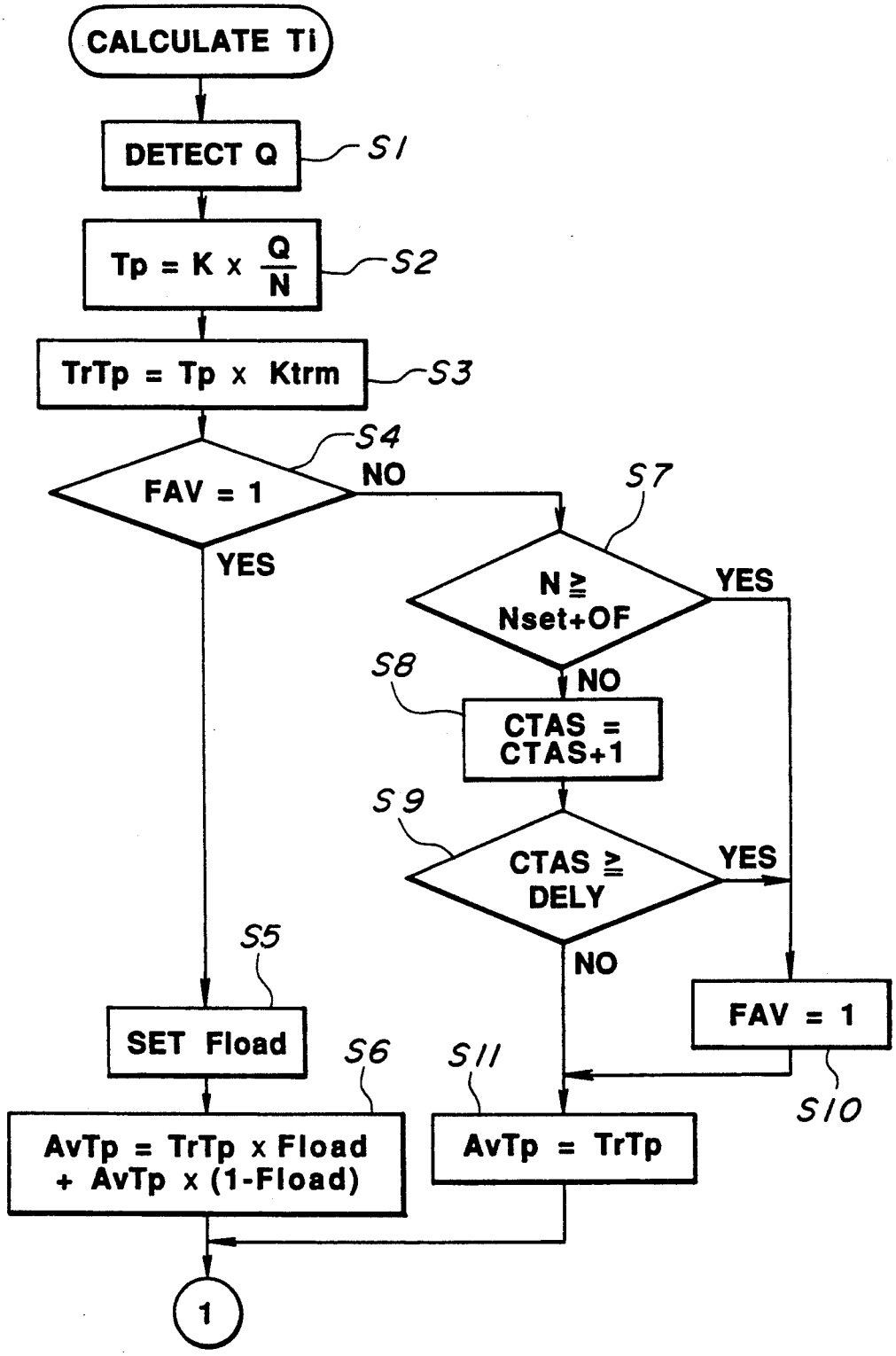
FIG. 2 is a flowchart of the former part of a routine for calculating a fuel injection amount, used in the fuel injection control system of FIG. 1.
Figure 3:
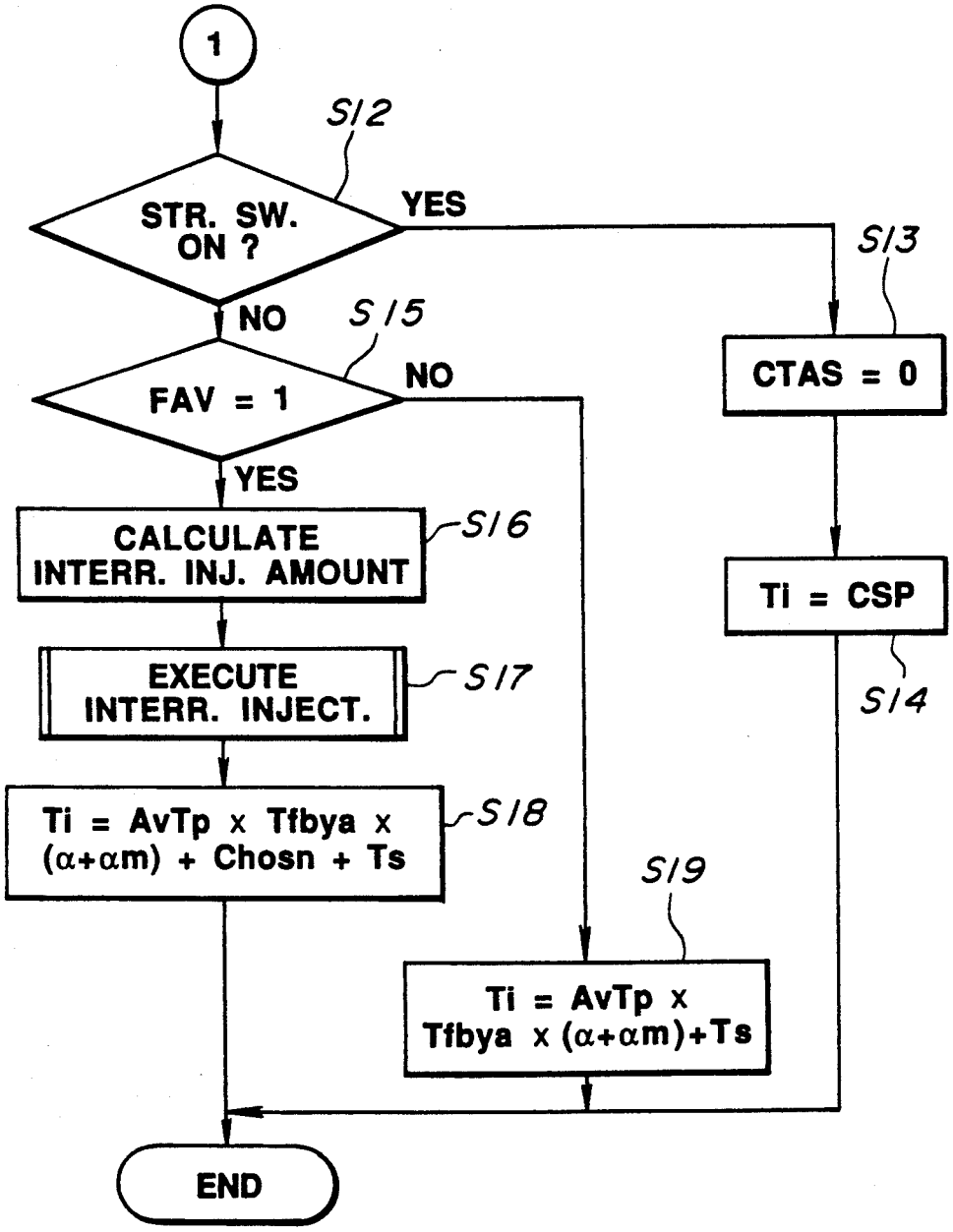
FIG. 3 is a flowchart of the latter part of the routine of FIG. 2.

The control unit 10 includes a microcomputer and is arranged to make a processing or operation in accordance with a fuel injection amount processing routine shown in a flowchart of FIGS. 2 and 3. The processing of the control unit 10 finally determines a fuel injection amount Ti which is the amount of fuel to be injected from the fuel injector valve 5. In this connection, the control unit 10 outputs the operating pulse signal which has a pulse width representing the fuel injection amount Ti, at a predetermined timing in timed relation to the engine speed, upon processing the signals from the variety of sensors. It will be understood that the energizing time of the electromagnetic coil of the fuel injector valve 5 corresponds to the pulse width of the operating pulse signal.

The manner of operation of the fuel injection control system F will be discussed with reference to the flowchart of FIGS. 2 and 3.

At a step S1, the voltage signal output from the hot wire mass air flow sensor 11 is read upon being subjected to an analog-to-digital conversion, and then undergoes a linearization treatment thereby to detect the intake air flow amount Q. At a step S2, a basic fuel injection amount $Tp=K\times Q/N$ (K=constant, N=engine speed) is calculated in accordance with the intake air flow amount Q. At a step S3, a basic fuel injection amount correction value ($TrTp=Tp\times Ktrm$) is calculated by multiplying the basic fuel injection amount Tp by an air-fuel ratio smoothing coefficient Ktrm (for correcting an error due to mechanical and structural factors of the intake air passageway P) which depends on the engine speed N and AvTp which will be subsequently discussed.

At a step S4, the value of a permission flag FAV of the compensation for time LAG is judged. When FAV=1 (after permission of carrying out the compensation for time LAG), the procedures of the steps S5 and S6 are executed. At the step S5, a weighting constant Fload ($0<\text{Fload}<1$) is searched from a map whose parameters are the engine speed N and the throttle valve opening degree TVO, and set. At the step S6, the compensation for time LAG or obtaining a moving average is executed, in which the moving average AvTp is calculated according to the following equation:

$$AvTp=TrTp\times\text{Fload}+AvTp\times(1\text{-Fload})$$

When FAV=0 (during prohibition of the compensation for time lug), the procedures of steps S7 to S11 are carried out. At the step S7, the engine speed N is compared with a predetermined value which is obtained by adding a positive or negative offset engine speed OF (according to requirements) to a target idle engine speed Nset depending on the coolant temperature Tw, thereby making a judgement as to whether the condition of N≧Nset°OF has been reached or not. The offset engine speed OF is for providing a freedom to a set value of the target idle engine speed Nset. It will be understood that the predetermined value may be a constant value or determined from a map and depending on the coolant temperature Tw.

When N<Nset+OF, a counter value CTAS representing a lapsed time after the engine starting is advanced by 1. At a step S9, the counter value CTAS is compared with a predetermined value DELY (for example, 1 to 2 seconds) to judge as to whether a condition of CTAS≧DELY has been reached or not. When CTAS<DELY, the flow of a routine goes directly to a Step S11 in which the basic fuel injection amount TrTp becomes the moving average AvTp as the following equation, so that no compensation for time lug is carried out:

$$AvTp=TrTp$$

When N≧Nset+OF at the judgement of the step S7 or when CTAS≧DELY at the judgement of the step 9, the flow goes to a step S10 at which the compensation permission flag FAV is set at 1, and thereafter the relationship of AvTp=TrTp is established at a step S11.

As shown in FIG. 3, the steps S6 and S11 are followed by a step S12 at which the switching ON or OFF of the engine starter switch 16 is judged, in which the flow goes to a step 13 during the switching ON (during engine starting). At the step S13, the counter value CTAS representing the lapsed time after the engine starting is reset. At a step S14, a fuel injection amount (at engine starting time) CSP depending on the coolant temperature Tw is calculated to determine the fuel injection amount Ti=CSP.

When the starter switch 16 is switched OFF (after the engine starting), the flow goes to a step S15 at which the value of the annealing permission flag FAV is judged. When FAV=1 (after permission of the compensation for time lug), the flow goes to a step S16 in order to accomplish a transient correction (wall flow correction) for the purpose of correcting the response delay due to liquified fuel flowing on the wall surface of the intake air passageway P. At the step S16, an interruption injection amount is calculated according to ΔAvTP (the variation amount of AvTp). The interruption injection amount is the amount of fuel to be temporarily injected from the fuel injector valve 5. Then, at a step S17, an interruption injection (temporary fuel injection from the fuel injector valve 5) is carried out through a separate routine. It is a matter of course that the interruption injection is not carried out when the ΔAvTp is small.

At a step S18, a fuel injection amount Ti is calculated according to the following equation:

$$Ti=AvTp\times Tfbya\times(\alpha+\alpha m)+Chosn+Ts$$

where Tfbya is a target air-fuel ratio correction coefficient including a coolant temperature-dependent increasing correction coefficient (for obtaining engine starting stability and depending on a coolant temperature representing cold engine to engine warm-up), an acceleration-dependent increasing correction coefficient (for raising an engine speed or response during acceleration), and the like; α is an air-fuel ratio feedback correction coefficient (for correcting a shift in air-fuel ratio in an air-fuel ratio feedback control); αm is a learning correction coefficient learned from the air-fuel ratio feedback correction coefficient; Chosn is a wall flow correction amount according to ΔAvTp, Chosn being for correcting the amount of fuel on the wall surface, changing with Tp (for example, an excessive fuel is injected during acceleration in which the wall surface fuel amount decreases owing to an high engine speed); and Ts is a voltage correction amount according to the voltage of a battery.

When FAV=0 (during prohibition of the compensation for time LAG) at the step S15, the flow goes to a step S19 without carrying out the interruption injection for correcting the response delay due to liquified fuel flowing on the passageway wall surface.

At a step S19, the fuel injection amount Ti is calculated according to the following equation:

$$Ti=AvTp\times Tfbya\times(\alpha+\alpha m)+Ts$$

Accordingly, the correction by the wall flow correction amount Chosn is not carried out.

It will be understood that the fuel injection amount Ti obtained at the steps S14, S18 and S19 corresponds to the pulse width of the operating pulse signal to be supplied to the electromagentic coil of the fuel injector valve 5, so that the amount of fuel to be injected from the fuel injector valve 5 is determined by the fuel injection amount Ti.

Thus, during a time period from the engine starting to the time immediately after the engine starting, the compensation for time LAG is inhibited through a flow route of the steps S4–S7–S8–S9–S11 until the engine speed reaches the predetermined value (Nset+OF). However, when the engine speed has reached the predetermined value (Nset+OF), the flow goes through a flow route of the steps S7 to S10 thereby to set the permission flat for the compensation for time LAG at 1, and thereafter the flow goes through a flow route of steps S4–S5–S6 thereby to execute the compensation for time lug or obtaining the moving average.

As appreciated from the above, according to the embodiment, during a time period from the engine starting to the time immediately after the engine starting, the compensation for time lug is prohibited until the engine speed N reaches the predetermined value. As a result, a difference in air-fuel ratio of an air-fuel mixture to be supplied to the engine cylinders is hardly made between a case of starting the engine immediately after the instant of making electric power supply by switching ON a power source switch and another case of starting the engine upon waiting a little while after the instant of making electric power supply. This suppresses at a lower value a difference in engine speed rising behaviors among a variety of engine starting manners, while stabilizing the emissions of CO and HC through the exhaust gas passageway G.

Additionally, since execution of the compensation for time lug depends upon the comparison of the engine speed N with the target idle engine speed Nset which depends on the coolant temperature Tw and becomes high at a low coolant temperature, the signal after the compensation for time lug can be obtained even in a low coolant temperature condition just as in a high temperature condition. Accordingly, it is readily made, for example, to set the fuel injection amount during engine starting and to increase the fuel injection amount after the engine starting. Furthermore, in a low coolant temperature condition, the air-fuel ratio of the mixture to be supplied to the engine cylinders are hardly affected by a high level (voltage) output of the hot wire mass air flow sensor 11 during the instant the electric power is being supplied to automotive parts, thereby effectively suppressing a scattering in the air-fuel ratio.

Figure 4:
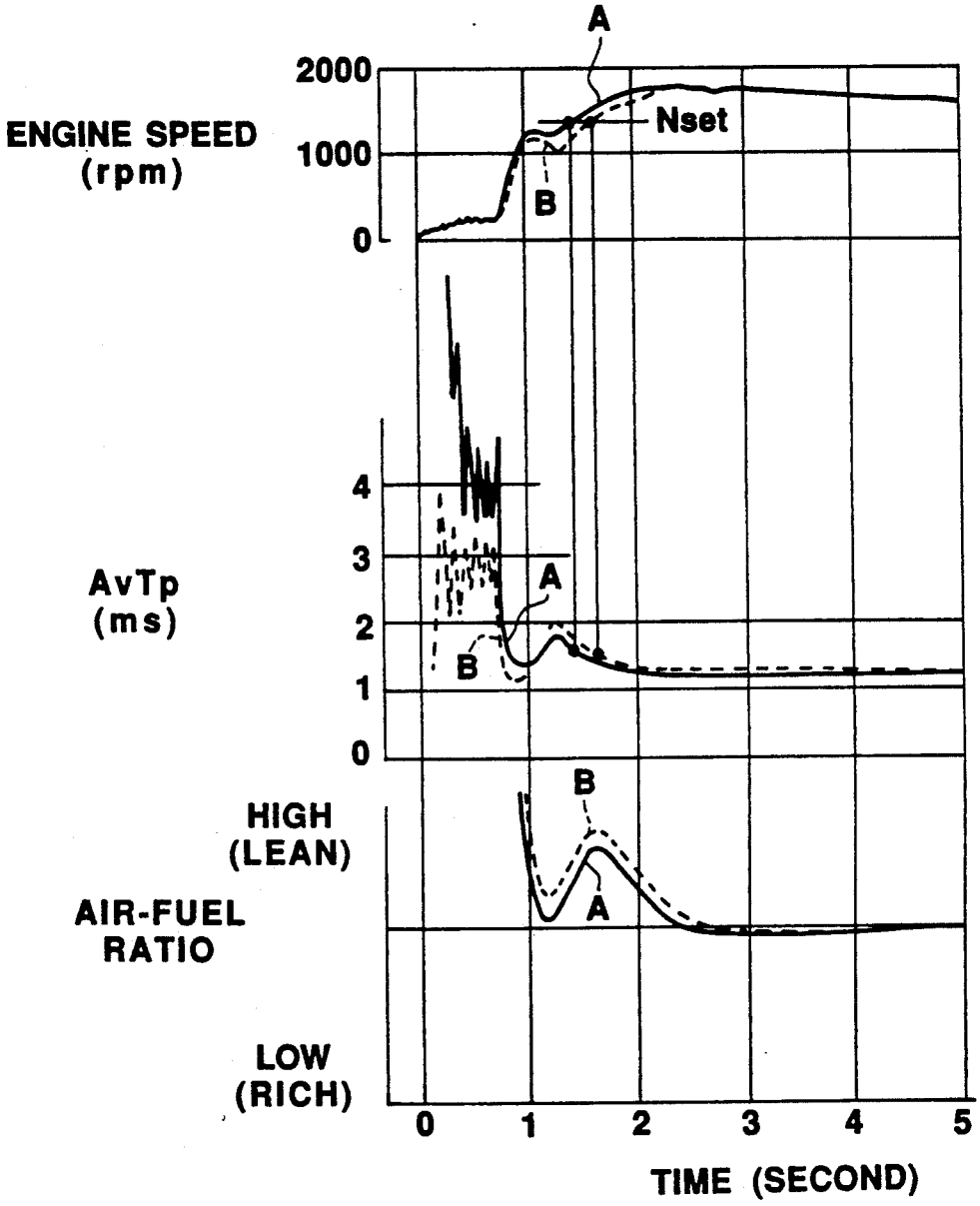
FIG. 4 are graphs illustrating engine control characteristics at cold start in the engine of FIG. 1.
Figure 5:
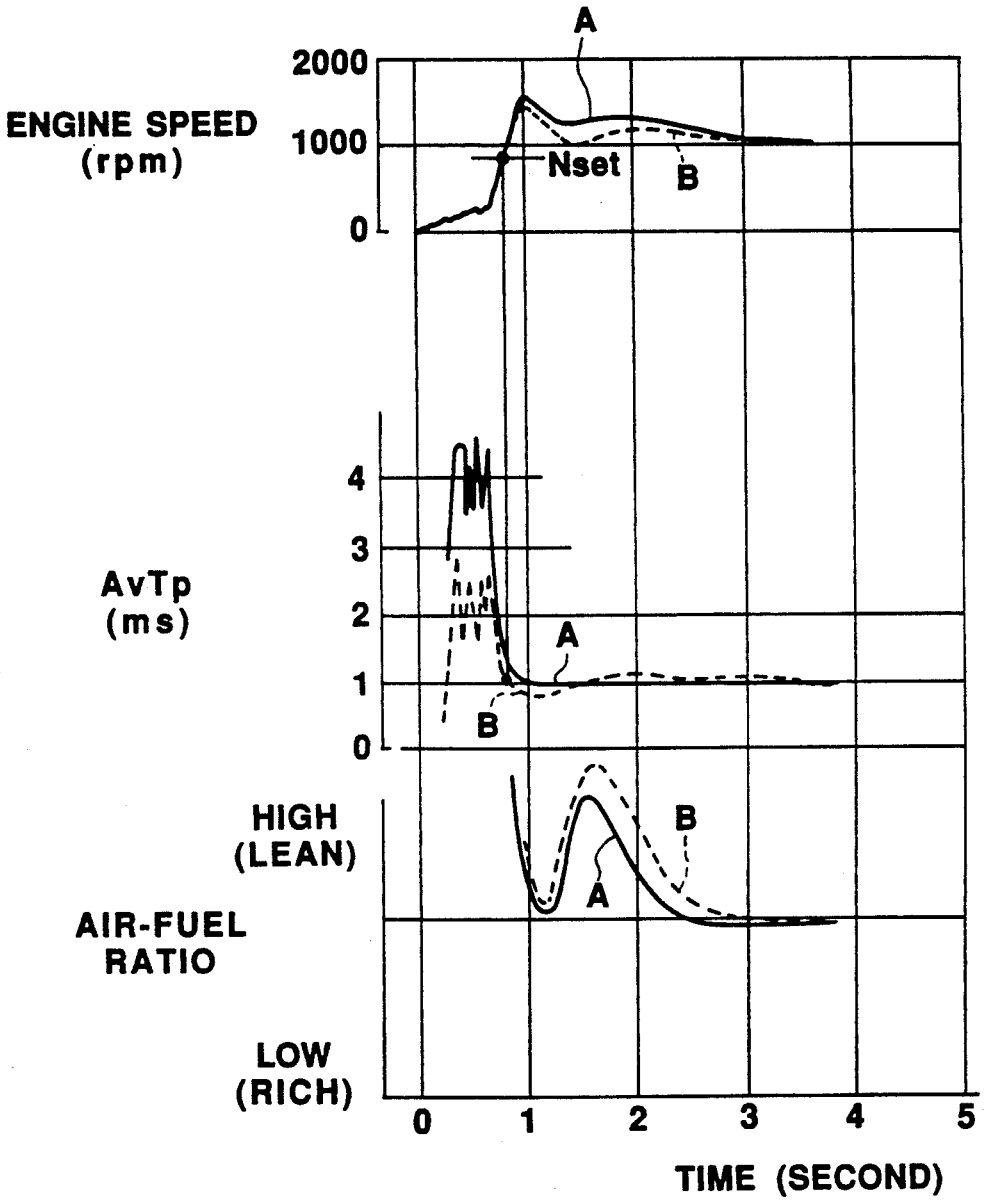
FIG. 5 are graphs illustrating engine control characteristics at hot start in the engine of FIG. 1.

FIG. 4 shows behaviors of engine speed, AvTp (moving average) and air-fuel ratio during a cold start, whereas FIG. 5 shows those during a hot start, in which so-called heavy gasoline is used as a fuel to be supplied from the fuel injector valve 5. The heavy gasoline contains aromatic hydrocarbons as a main component and therefore is relatively low in volatility and high in specific gravity. In FIGS. 4 and 5, solid curves A indicates those in the case of making engine starting immediately after the instant of making an electric power supply, while broken curves B indicate those in the case of making engine starting upon waiting 5 seconds after the instant of making the power supply. The data of FIGS. 4 and 5 were obtained by conducting experiments using the engine as shown in FIG. 1. The experimental results of FIGS. 4 and 5 revealed that the engine operation behaviors are similar between the case of making engine starting immediately after the instant of making the electric power supply and the another case of making engine starting upon waiting a little while after the instant of making electric power supply.

As described above, even if the engine speed N has not reached the predetermined value (Nset+OF), the flow goes through a flow route of the steps S9–S10 to set the compensation for time LAG permission flag FAV at 1 when a predetermined time has lapsed after the starter switch 16 is switched OFF, thereafter the flow goes through a flow route of the steps S4–S5–S6 thereby executing the compensation for time lug or obtaining the moving average.

During prohibition of the compensation for time lug, the flow proceeds through the flow route of the steps S15 to S19 thereby to prohibit the transient correction (wall flow correction). In other words, during the prohibition of the compensation for time LAG, the correction for the response delay due to the liquified fuel flow on the passageway wall surface is not carried out; however, a variation amount due to the fuel flow on the wall is compensated with an automatic acceleration and deceleration correction in which Tp is overshot at an increased engine load while it is undershot at a decreased engine load. Such an automatic acceleration and deceleration connection is inherent in a so-called L-Jetronic fuel injection system which relies on the air flow sensor that generates a voltage signal proportional to the volume of air actually drawn into the engine intake manifold. Of course, when the compensation for time LAG begins, the high precision correction can be made in accordance with the amount and behavior of the liquified fuel flow on the intake passageway wall surface. Accordingly, a suitable fuel injection amount can be obtained even in a case where a throttle operation is made during engine starting and at a time immediately after the engine starting, and even in another case when the air-fuel ratio largely deviates from a target level owing to, for example, fuel leak from the fuel injector valve.

As discussed above, if the engine speed N has not exceeded the predetermined level, the flow of the routine shifts to the compensation for time LAG at a time at which the predetermined time has lapsed after the starter switch is switched OFF. As a result, even in the case where engine speed rising is slow owing to a lean condition of air-fuel mixture during engine staring (for example, caused by using the heavy gasoline or by adherence of intake deposit), the flow of the routine can be smoothly changed into a procedure or processing that accomplish a high precision wall flow correction, thereby enabling a suitable control to be made at transient engine operating conditions.

Figure 6:
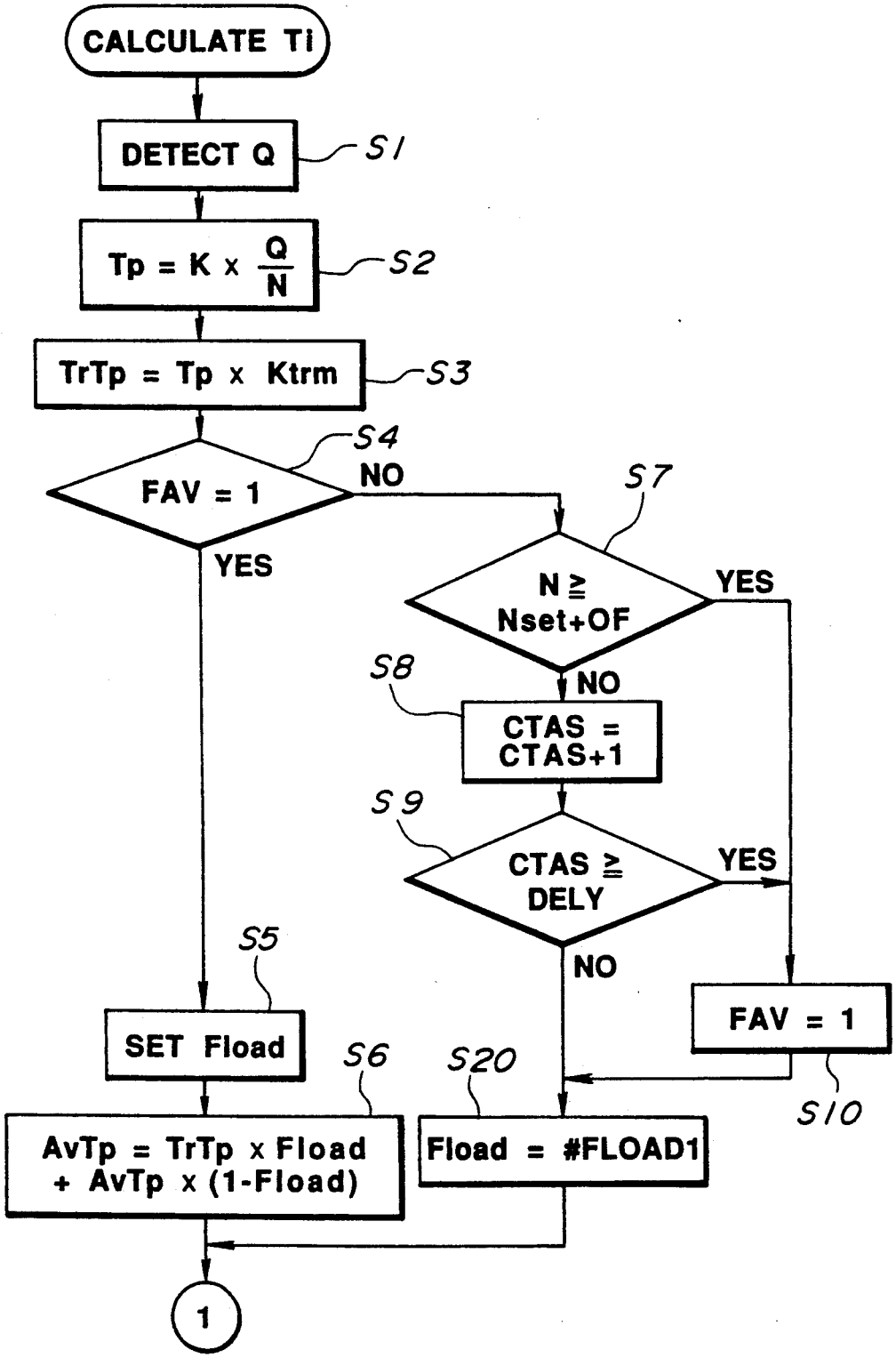
FIG. 6 is a flowchart similar to that of FIG. 2 but showing the routine for calculating a fuel injection amount, used in another embodiment of the fuel injection control system according to the present invention.

FIG. 6 illustrates an operational manner of another embodiment of the fuel injection control system F in accordance with the present invention, which is similar to that shown in the flowchart of FIGS. 2 and 3 in connection with the above-discussed embodiment of FIG. 1 with the exception that a step S20 is added in place of the step S11 for the purpose of lightening or reducing the compensation for time LAG. More specifically, the steps S9 and S10 are followed by the step S20 in which the relationship of Fload=#FLOAD1 is established. Here, as the #FLOAD1 is closer to 1, the compensation for time LAG is lightened or reduced. In case of #FLOAD1=0, the compensation for time LAG is prohibited.

Figure 7:
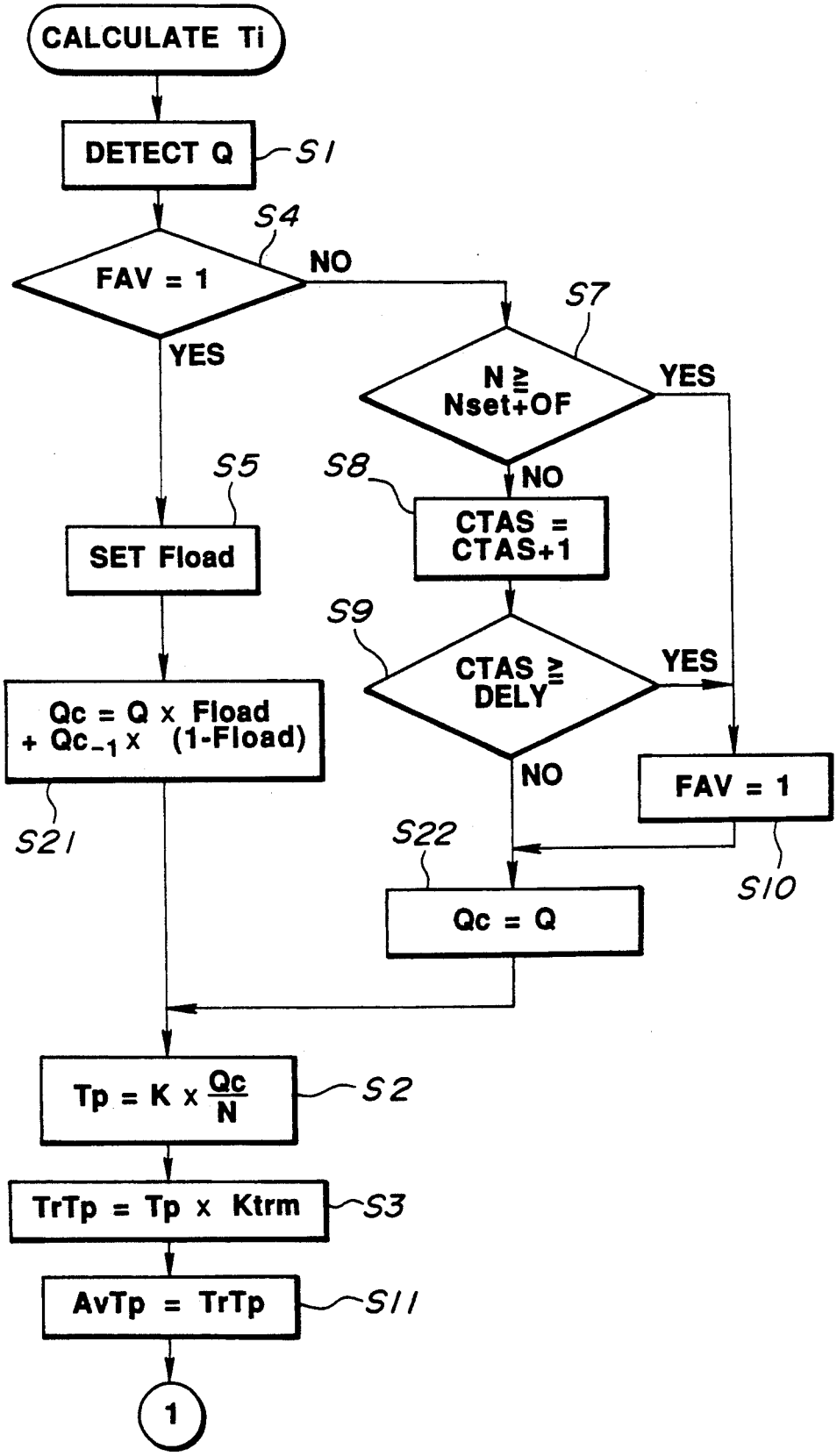
FIG. 7 is a flowchart similar to that of FIG. 2 but showing the routine for calculating a fuel injection amount, used in a further embodiment of the fuel injection control system according to the present invention.

FIG. 7 illustrates an operational manner of a further embodiment of the fuel injection control system F in accordance with the present invention, which is similar to that shown in the flowchart of FIGS. 2 and 3 with the exception that the steps S2 and S3 are moved after the steps 4 and 5, in which the step S5 is followed by a step S21 while the steps S9 and S10 are followed by a step S22. In this embodiment, the compensation for time LAG is applied to the intake air flow amount Q to be used for calculating the fuel injection amount Ti. More specifically, at the step S21, a calculation of $Qc=Q\times Fload+Qc_{-1}\times(1-Fload)$ is carried out, in which TrTp at the step S6 is replaced with Qc ($Qc_{-1}$: the value at a prior time). Qc represents an air flow amount supplied into the engine cylinders. At the step S21, the compensation for time LAG is thus applied to the intake air flow amount Q. At the step S22, the relationship of Qc=Q is established. It will be seen that at the step S2 in this embodiment, Qc is used in place of Q in the embodiment of FIGS. 1 to 3.

What is claimed is:

1. A fuel injection control system for an internal combustion engine having an air flow sensor and a fuel injector valve, said fuel injection control system comprising:

means for detecting an intake air flow amount in accordance with a signal generated by the air flow sensor;

means for calculating a fuel injection amount in accordance with said intake air flow amount;

means for controlling a fuel injection from the fuel injector valve in accordance with said fuel injection amount;

means for applying a compensation for time LAG in a process of calculation for obtaining said fuel injection amount;

means for detecting a rising engine speed during a time period from an engine starting to a time immediately after the engine starting; and means for reducing an effect of said compensation for time LAG until said engine speed has reached a predetermined value.

2. A fuel injection control system as claimed in claim 1, wherein said compensation applying means includes means for applying said compensation for time LAG onto said intake air flow amount.

3. A fuel injection control system as claimed in claim 1, wherein said compensation applying means includes means for applying said compensation for time LAG onto an intermediate variable which is obtained from said intake air flow amount, said intermediate variable being used for obtaining said fuel injection amount.

4. A fuel injection control system as claimed in claim 1, wherein said compensation effect reducing means includes means for prohibiting said compensation for time LAG until said engine speed has reached a predetermined value.

5. A fuel injection control system as claimed in claim 1, wherein said air flow meter is a hot wire mass air flow meter.

6. A fuel injection control system as claimed in claim 3, wherein said compensation for time LAG applying means includes means for calculating a moving average of said intermediate variable.

7. A fuel injection control system as claimed in claim 1, wherein said predetermined of said engine speed approximately corresponds to a target idle engine speed at which the engine runs during idling.

8. A fuel injection control system as claimed in claim 4, wherein said prohibiting means includes means by which said predetermined value of said engine speed depends on an engine coolant temperature.

9. A fuel injection control system as claimed in claim 1, further comprising means for detecting first and second states of an engine starter switch, said engine starter switch being switched ON and OFF respectively at said first and second stages.

10. A fuel injection control system as claimed in claim 9, further comprising means for applying said compensation for time LAG onto said intermediate variable when a predetermined time has lapsed after said engine starter switch is changed into said second state, even under a condition that said engine speed is still lower than said predetermined value.

* * * * *